US006107566A

United States Patent [19]

Quadir et al.

[11] Patent Number: 6,107,566

[45] Date of Patent: Aug. 22, 2000

[54] HERMETIC TERMINAL STRUCTURE

[75] Inventors: Tariq Quadir, Butler County; Glenn A. Honkomp, Warren County, both of Ohio

[73] Assignee: Emerson Electric Co., St. Louis, Mo.

[21] Appl. No.: 09/188,161

[22] Filed: Nov. 7, 1998

[51] Int. Cl.[7] ..... H01J 15/00

[52] U.S. Cl. ..... 174/50.52; 174/50.59; 174/50.61; 174/50.63; 439/935

[58] Field of Search ..... 174/50.52, 50.59, 174/50.61, 50.63, 152 AM; 439/935, 926

[56] References Cited

U.S. PATENT DOCUMENTS

| | | | |
|---|---|---|---|
| 2,517,023 | 8/1950 | Prakke | 174/35 TS |
| 3,721,948 | 3/1973 | Brandt et al. | 439/695 |
| 4,103,416 | 8/1978 | Sakamoto | 29/827 |
| 4,584,433 | 4/1986 | Bowsky et al. | 174/152 |
| 4,984,973 | 1/1991 | Itameri-Kinter et al. | 417/422 |
| 5,471,015 | 11/1995 | Paterek et al. | 174/152 |
| 5,675,122 | 10/1997 | Taylor | 174/50.58 |
| 5,703,326 | 12/1997 | Yamada et al. | 174/50.2 |
| 5,736,675 | 4/1998 | Michaels | 174/50.5 |

*Primary Examiner*—Kristine Kincaid
*Assistant Examiner*—Dhiru R Patel
*Attorney, Agent, or Firm*—Polster, Lieder, Woodruff & Lucchesi, L.C.

[57] ABSTRACT

A hermetic terminal assembly including a body member with a bottom portion and a surrounding boundary or flange portion with at least one current conducting pin sealed in an opening in the bottom portion and an over-surface stratum disposed in said body member in close proximity facing relation with said bottom and boundary portions, and having stratum holding material therefor.

17 Claims, 1 Drawing Sheet

HERMETIC TERMINAL STRUCTURE

BACKGROUND OF THE INVENTION

The present invention relates to hermetic terminal structural assemblies and more particularly to hermetic terminal assemblies which maximize over-surface distance.

In the hermetic terminal assembly art, a number of construction arrangements have been utilized to prevent conductive pins, which pins serve to conduct current to isolated drive sources such as drive motors, disposed in hermetically sealed compressor housing shells, from electrically shorting to surrounding electrically conductive areas such as the aforementioned housing shells of compressors. These past arrangements have included surrounding conductive pins with insulated over-surface collars or sleeves, such as the insulating extended sleeve arrangement 23 disclosed in U.S. Pat. No. 4,584,433, issued to B. Bowsky, et al. on Apr. 22, 1986 and the sleeve arrangement 17 disclosed in U.S. Pat. No. 5,471,015, issued to F. Dieter Paterek, et al. On Nov. 28, 1995. These two aforementioned patents were further concerned with conductive pin fusing and with pin chemistry, respectively, attention being particularly directed to the aperture 38 of flattened neck portion 37 of pin 17 in U.S. Pat. No. 4,584,333 and to the relative coefficients of expansion and softening point temperatures in U.S. Pat. No. 5,471,015. A still somewhat different arrangement to minimize electrical shorting is disclosed in U.S. Pat. No. 4,984,973, issued to T. Itameri-Kinter et al. on Jan. 15, 1991, wherein an electrically insulated cap member along with an electrically insulative adhesive provides an over-surface between a conductive pin and a metallic body member with gaps being provided between the cap and metallic body member and the pin and cap member allegedly to protect the over-surface from contaminants and possible unwanted current paths.

In accordance with the present invention, a novel and unique hermetic terminal structure is provided which utilizes in part some of the features of past terminals and at the same time recognizes and avoids a number of previous structural limitations and problems, the present invention providing a unique and unobvious over-surface and pin construction for hermetic terminal assemblies which minimizes the possibilities of electrical shorting and, at the same time, which is straightforward and economical in manufacture, assembly and maintenance, requiring a minimum of operating steps and parts in manufacture, assembly and maintenance.

Various other features of the present invention will become obvious to one skilled in the art upon reading the disclosure set forth herein.

BRIEF SUMMARY OF THE INVENTION

More particularly the present invention provides a unique hermetic terminal assembly comprising: a body member including a generally flat bottom portion and a boundary or flange portion extending along the periphery of the bottom portion, the bottom portion having at least one opening therein; a current conducting pin extending through the bottom portion opening; a stratum of insulating material facing the bottom and boundary or flange portions of the body member in close fit proximity therewith, the stratum of insulating material having at least one opening corresponding with the opening of said bottom portion of the body member with the current conducting pin also extending therethrough; insulating pin sealing means extending between and sealing the periphery of said current conducting pin to the periphery of the opening in the bottom portion; and stratum holding means to maintain the stratum in proximate close fit facing position with respect to the bottom and the boundary or flange portions of the body member and to fill any spaces therebetween. In addition, the present invention provides novel arrangements for holding the stratum in close fit relation with the body member portions and provides for stratum treatment and design which enhances the sealing of spaces therebetween, including the utilization of a fluid binding insulating adhesive which sets to hold the stratum firmly in close proximity to the body member with minimum space therebetween to prevent contaminant filling.

It is to be understood that various changes can be made by one skilled in the art in one or more of the several parts of the novel structural assembly disclosed herein without departing from the scope or spirit of the present invention.

BRIEF DESCRIPTION OF THE DRAWINGS

Referring to the drawings which disclose an advantageous embodiment of the present invention and a modification thereof.

DETAILED DESCRIPTION OF THE INVENTION

Figure 2:
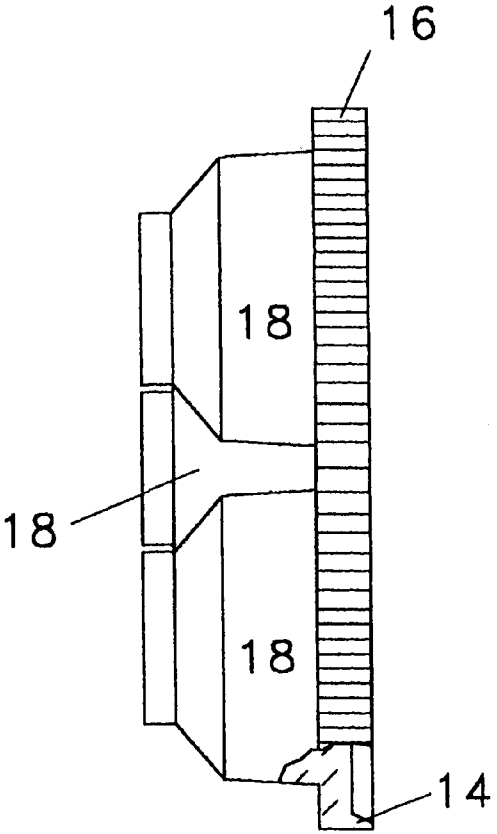

As can be seen in the drawings, the hermetic terminal assembly 2 includes a metallic cupshaped body member 3 which is of a preselected configuration and which is formed from cold rolled steel material—all as is generally well known in the art. Cup-shaped body member 3 includes a generally flat bottom portion 4 and a boundary portion 6, here disclosed in the form of an integral flange or sidewall extending along and outwardly from the periphery of bottom portion 4 to surround the inner face of bottom portion 4. As also is known in the art, bottom portion 4 is provided with three substantially equally spaced and equally sized openings 7 (only one of which can be seen in FIG. 1). Each opening 7 is defined by an interior wall surface of annular lip 8 which is an integral part of cup-shaped body member 3 and which extends outwardly from the inner face of bottom portion 4 to be within boundary or flange 6 of body member 3. A suitable electric current conductive pin 9 extends through each opening 7 with the peripheral, circumferential surface of each pin 9 being spaced in relation to the interior wall surface of annular lip 8 and each opening 7.

An insulating glass seal 11 extends between the circumferential periphery of each pin 9 and the wall of the respective opening 7 and the interior wall surface of annular lip 8 to seal the pin 9 in body member 3 so as to be in insulated relation with the body member 3.

In accordance with one feature of the present invention, an extended over-surface stratum 12 of wafer-like or disk form and of suitable insulating material capable of resisting temperatures as low as one-hundred-twenty (120) degrees Fahrenheit to as high or higher than two-hundred-fifty (250) degrees Fahrenheit, and as high as approximately three hundred (300) degrees Fahrenheit, advantageously of a filled polyphenyl sulfide is provided to fit in close proximity with the inner face of bottom portion 4 and the inner face of flange or sidewall 6 of cup-shaped body member 3. Stratum 12 can be of varying thickness, depending upon the environmental conditions involved, so as to be appropriately sized and configured in wafer form. The thickness of the stratum can be in the approximate range of point zero four (0.04) inches to zero point one (0.1) inches and advantageously point zero five (0.05) inches. The wafer-like stratum 12 can include three openings 13, each opening correspondingly aligned with one of the openings 7 in the bottom portion 4 of body member 3 (only one such opening being disclosed in FIG. 1 of the drawings). In this regard, it is to be noted that each stratum opening 13 is not only positioned to be correspondingly aligned with an opening 7 in the bottom portion 4 of cup-shaped body member 3, but the stratum opening 13 is further sized to engage in close proximity fit with an outer periphery of annular lip 8.

Figure 1:
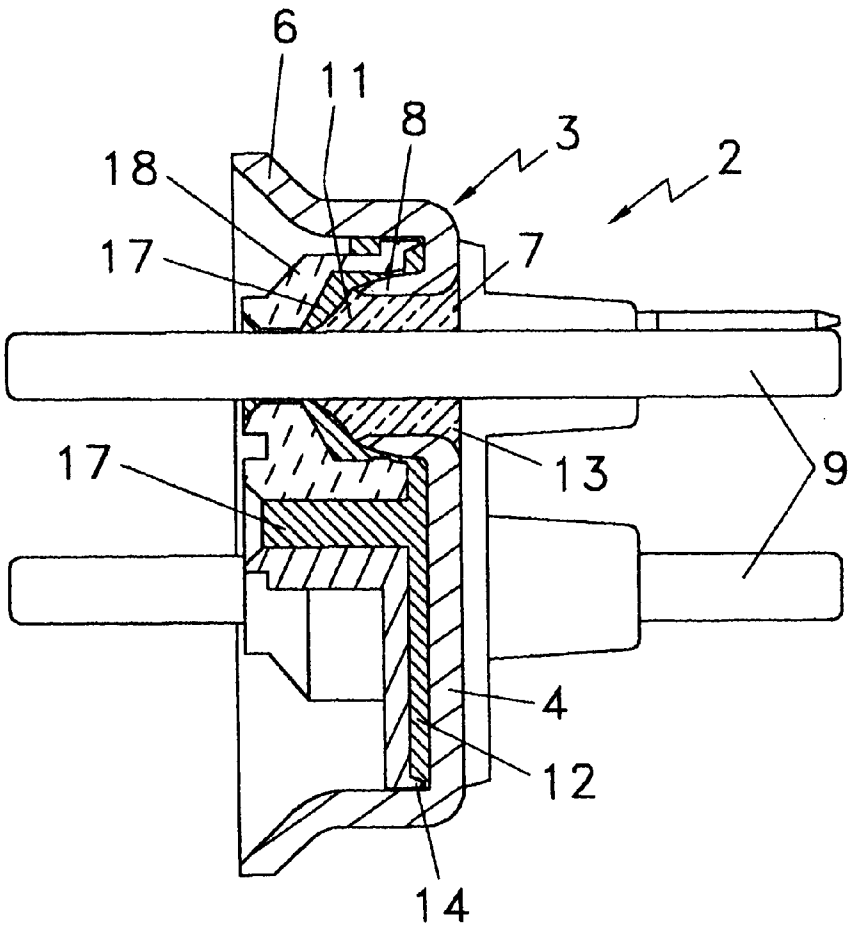
FIG. 1 is a schematic, cross-sectional view of a hermetic terminal assembly incorporating one embodiment of the present invention; and, FIG. 2 is a slightly enlarged, partially broken away, overall side view of a novel insulated stratum, a portion of which is incorporated as part of the hermetic terminal assembly of FIG. 1.

As can be seen in FIG. I of the drawings, the bottom face of wafer-like stratum 12 adjacent the inner face of bottom portion 4 is provided with a peripherally extending ridge 14 and, as can be seen in FIG. 2, the peripheral outer face of wafer-like stratum 12 can be knurled to provide ridges 16, the irregularly created surface by ridges or knurls 16 presenting concomitant spaces to retain an insulating liquid epoxy adhesive 17 of preselected flow and setting properties which when injected will fill any spaces between stratum 12 and the facing portions of cup-shaped body member 3 of FIGS. 1 and 2. In this regard, it is further to be noted that in the inventive embodiment of FIGS. 1 and 2, wherein the stratum 12 is held in close proximity facing position with respect to the inner face of bottom portion 4, the outer face of annular lips 8 adjacent the corresponding openings and the inner face of boundary or flange portion 6, that stratum 12 can be provided with three female insulating crowns 18 (FIG. 2). Each crown 18 accommodates passage of a current conducting pin 9 therethrough and engages in close proximity to the outer face surfaces of annular lip 8 and a glass seal 9. It is to be noted that any spaces between the close proximity engaging parts and crowns 18 are also filled with insulating liquid epoxy adhesive 17—this further adhesively enhancing the maintenance of the stratum 12 in the close proximity facing position and minimizing the possibilities of the lodging of undesirable contaminants and electrical shorting.

The invention claimed is:

1. A hermetic terminal assembly comprising: a metallic body member including a generally flat bottom portion having a periphery and a boundary portion extending along said periphery of said bottom portion, said bottom portion having at least one opening including a periphery therein; a current conducting pin including a periphery extending through said at least one opening; a stratum of insulating material facing said bottom and said boundary portions of said body member in close fitting proximity therewith, said stratum of insulating material having at least one opening corresponding with said at least one opening of said bottom portion of said body member with said current conducting pin also extending therethrough; insulating pin sealing means extending between and sealing said periphery of said current conducting pin to said periphery of said at least one opening in said bottom portion; and stratum holding means to maintain said stratum in facing close fitting proximity position with respect to said bottom and said boundary portions of said body member to provide face close proximity surfaces.

2. The hermetic terminal assembly of claim 1, said stratum holding means to hold said stratum in facing close fitting proximity position with respect to said bottom portion and said boundary portion of said body member comprising an insulating fluid binding adhesive which sets between said stratum of insulating material and said body member portion filling spaces therebetween.

3. The hermetic terminal assembly of claim 1, said stratum of insulating material being capable of resisting temperatures as low as one-hundred-twenty (120) degrees Fahrenheit and as high as two-hundred-fifty (250) degrees Fahrenheit.

4. The hermetic terminal assembly of claim 1, said stratum of insulating material having a thickness in an approximate range of point zero four (0.04) inches to zero point one (0.1) inches.

5. The hermetic terminal assembly of claim 1, said stratum of insulating material having a thickness of point zero five (0.05) inches.

6. The hermetic terminal assembly of claim 1, at least one of said close proximity facing surfaces of said stratum and said body member portions including retaining ridges.

7. The hermetic terminal assembly of claim 1, said body member being cup-shaped to include said bottom portion in flat configuration with said boundary portion being in a form of an outwardly extending flange as part of said boundary portion.

8. The hermetic terminal assembly of claim 1, said insulating pin sealing means being glass.

9. The hermetic terminal assembly of claim 1, said at least one opening in said body portion including an annular lip with said insulating pin sealing means extending between said periphery of said conducting pin and said annular lip.

10. The hermetic terminal assembly of claim 1, said stratum being a filled plastic material.

11. The hermetic terminal assembly of claim 1, said stratum being a wafer of polyphenyl sulfide.

12. The hermetic terminal assembly of claim 1, said stratum holding means being an insulating liquid epoxy adhesive of preselected flow and setting proportions.

13. The hermetic terminal assembly of claim 1, said at least one opening in said bottom portion including an annular lip with said insulating pin sealing means extending between the periphery of said conducting pin and said annular lip, said stratum including a raised crown portion to surroundingly extend thereover.

14. The hermetic terminal assembly of claim 1, said stratum of insulating material facing said bottom portion of said body member having a peripheral ridge to form a retaining wall.

15. The hermetic terminal assembly of claim 1, said stratum of insulating material facing said boundary portion of said body member having a preselectively knurled surface forming retaining ridges thereon.

16. The hermetic terminal assembly of claim 1, said bottom portion and said stratum of insulating material including corresponding spaced openings; and, spaced current conducting pins passing respectively therethrough.

17. A hermetic terminal assembly comprising: a metallic cup-shaped body member including a generally flat bottom portion having an inner face and a periphery and a boundary portion in the form of an integral flange extending along and outwardly from said periphery of said bottom portion to surround said inner face of said bottom portion, said bottom portion having equally spaced and equally sized openings therein with each of said openings having a periphery and an annular lip extending along said periphery thereof in surrounding relation therewith and outwardly from said inner face of said bottom portion, each of said annular lips having an inner periphery; a current conducting pin extending through each one of said openings with the peripheral surface of each of said current conducting pins in spaced relation to said periphery of each of said openings and said inner periphery of each of said outwardly extending surrounding annular lips; insulating glass seals extending between the periphery of each of said current conducting pins and said respective openings in said bottom portion and said annular lip periphery to seal said current conducting pin in said openings, an insulated wafer-like stratum of filled polyphenyl sulfide of point zero five (0.05) inches thickness capable of resisting temperatures as high as approximately three hundred (300) degrees Fahrenheit and having openings, each corresponding with one of the openings in said bottom portion of said cup-shaped bottom member, said wafer-like stratum including preselectively knurled surfaces sized and contoured to be in close proximity facing said bottom and said boundary portions in a form of said surrounding and outwardly extending flange; and stratum holding means to maintain said stratum in facing close fitting proximity position with respect to said bottom portion, said annular lips adjacent each of said corresponding openings and said boundary portion flange.

* * * * *

(Also Form PTO-1050)

UNITED STATES PATENT AND TRADEMARK OFFICE

CERTIFICATE OF CORRECTION

PATENT NO : 6,107,566

DATED : August 22, 2000

INVENTOR(S) : Tariq Quadir, Glenn A. Honkomp

It is certified that error appears in the above-identified patent and that said Letters Patent are hereby corrected as shown below:

Col. 4, Line 18
Replace "portions"
with --portion--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*